US006941785B2

(12) United States Patent
Haynes et al.

(10) Patent No.: US 6,941,785 B2
(45) Date of Patent: Sep. 13, 2005

(54) ELECTRIC FUEL PUMP CONDITION MONITOR SYSTEM USING ELECTRICAL SIGNATURE ANALYSIS

(75) Inventors: Howard D. Haynes, Knoxville, TN (US); Daryl F. Cox, Knoxville, TN (US); Donald E. Welch, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 10/437,630

(22) Filed: May 13, 2003

(65) Prior Publication Data

US 2004/0230384 A1 Nov. 18, 2004

(51) Int. Cl.[7] ..... B21D 39/08

(52) U.S. Cl. ..... 72/57; 417/44.11; 318/799

(58) Field of Search ..... 702/38, 57–60, 702/64–68, 76, 77, 96, 104–106, 115, 116, 182–185, 191, 56; 318/432, 798, 799, 800, 801; 417/44.1, 44.11; 324/372, 772

(56) References Cited

U.S. PATENT DOCUMENTS 3,662,252 A * 5/1972 Smith ..... 322/89
4,373,150 A * 2/1983 Ritter ..... 388/809
4,761,703 A * 8/1988 Kliman et al. ..... 361/23
5,047,704 A * 9/1991 Yamauchi ..... 318/801
5,049,815 A * 9/1991 Kliman ..... 324/772
5,445,028 A * 8/1995 Bianchi et al. ..... 73/593
5,519,337 A * 5/1996 Casada ..... 324/772
5,521,482 A * 5/1996 Lang et al. ..... 318/800
5,578,937 A * 11/1996 Haynes et al. ..... 324/772
5,680,025 A * 10/1997 Bowers et al. ..... 318/806
5,689,194 A 11/1997 Richards, II et al.
5,995,910 A * 11/1999 Discenzo ..... 702/56
6,199,023 B1 3/2001 Kliman
6,236,947 B1 * 5/2001 Dowling et al. ..... 702/38
6,308,140 B1 * 10/2001 Dowling et al. ..... 702/60
6,404,162 B1 * 6/2002 Tajima et al. ..... 318/799
6,414,455 B1 * 7/2002 Watson ..... 318/432
6,459,230 B1 * 10/2002 Tao ..... 318/798
6,640,196 B1 * 10/2003 Unsworth et al. ..... 702/115
6,709,240 B1 * 3/2004 Schmalz et al. ..... 417/44.11
6,757,665 B1 * 6/2004 Unsworth et al. ..... 706/15

OTHER PUBLICATIONS

D.E. Welch, H.D. Haynes, D.F. Cox, R.J. Moses; "Electrical Signature Analysis (ESA) As A Diagnostic Maintenance Technique for Detecting The High Consequence Fuel Pump Failure Modes"; 6th Joint FAA/DoD/NASA Conference on Aging Aircraft, Sep. 16, 2002.

* cited by examiner

*Primary Examiner*—Marc S. Hoff
*Assistant Examiner*—Mohamed Charioui
(74) *Attorney, Agent, or Firm*—Kirk A. Wilson

(57) ABSTRACT

A pump diagnostic system and method comprising current sensing probes clamped on electrical motor leads of a pump for sensing only current signals on incoming motor power, a signal processor having a means for buffering and anti-aliasing current signals into a pump motor current signal, and a computer having a means for analyzing, displaying, and reporting motor current signatures from the motor current signal to determine pump health using integrated motor and pump diagnostic parameters.

29 Claims, 16 Drawing Sheets

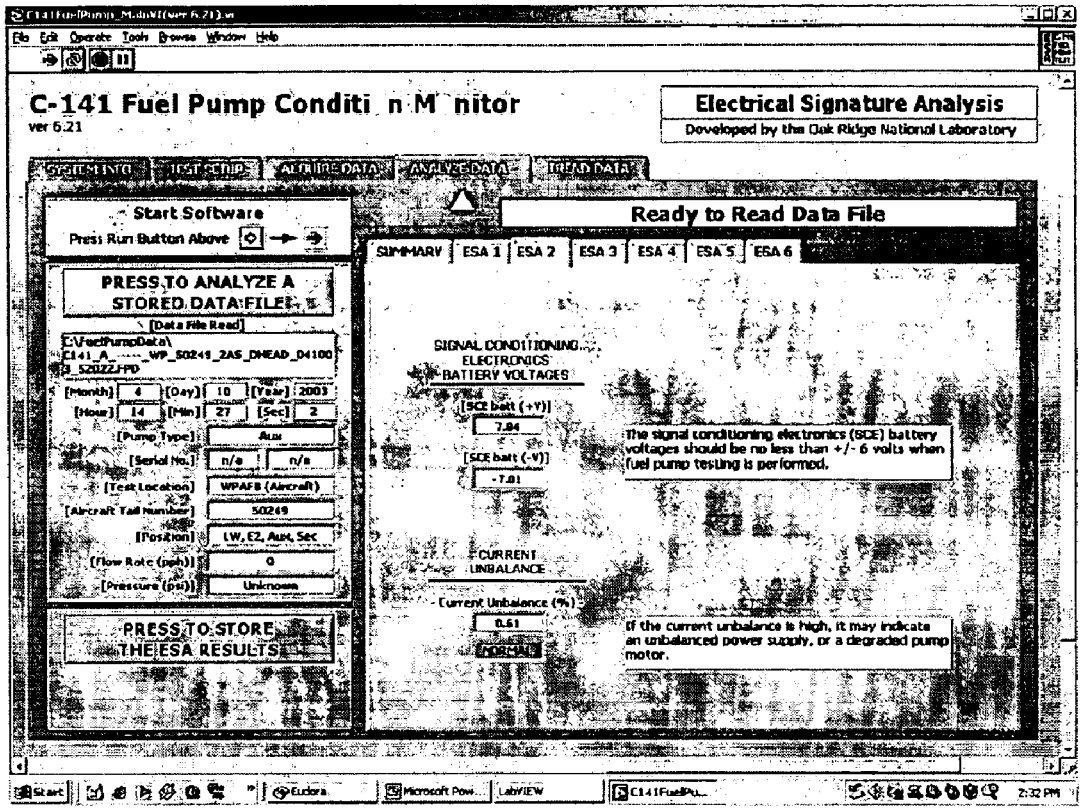
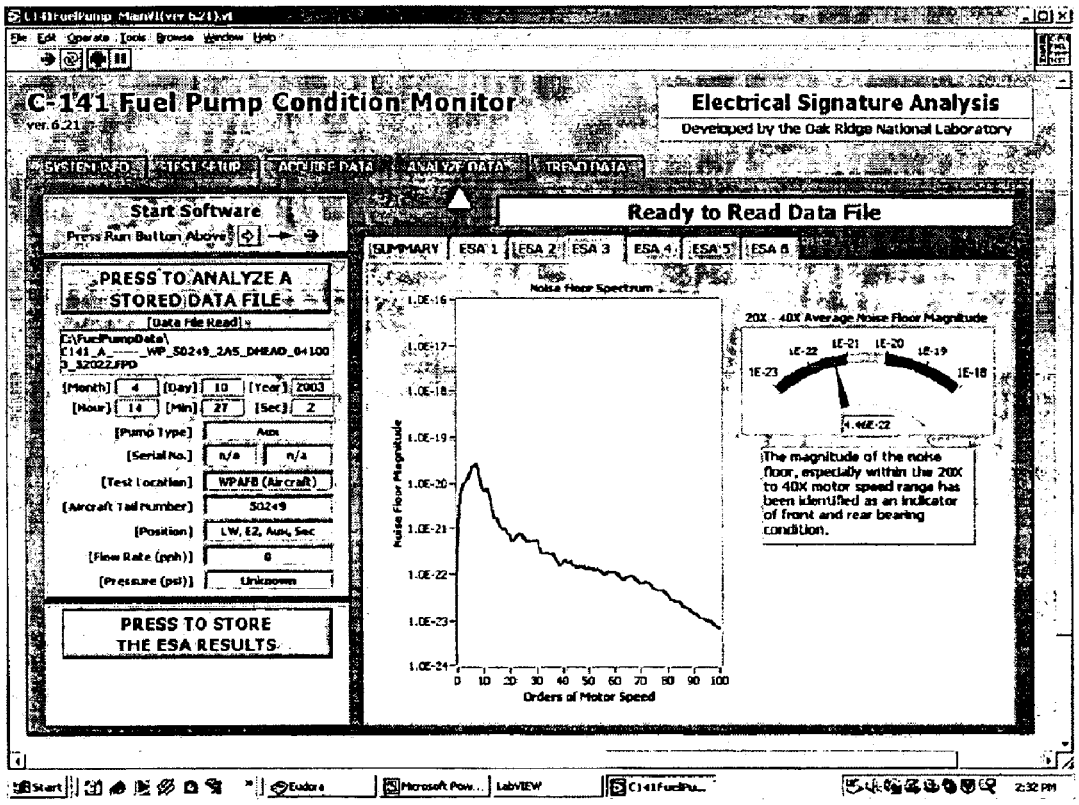
Fig. 5C

Fuel Pump Data (.FPD) File Format
text file (4 column X 125005 rows)

*Header*

| | | | |
|---|---|---|---|
| month | day | year | pump type code |
| prefix | serial number | flow rate (lb/hr) | pressure (psi) |
| sample rate (pps) | samples | probe mv/A | probe mv/A |
| location code | position code | DAQ VI version | SCE battery (+V) |
| SCE battery (-V) | tail number | DAQ time during day (sec) | (future use) |
| neutral magnitudes | T1 phase magnitudes | T2 phase magnitudes | T3 phase magnitudes |

*Data*

Example Data File

| | | | |
|---|---|---|---|
| 10 | 22 | 2002 | 1 |
| 3 | 0 | 0 | -1 |
| 25000 | 125000 | 100 | 100 |
| 3 | 8 | 5.74 | 6.46935 |
| -6.50765 | 60132 | 50745 | 0 |
| -0.203542 | -2.67176 | -7.4477 | 10.048 |
| 0.0390729 | -1.66773 | -8.28693 | 9.56272 |
| 0.274058 | -0.672857 | -8.94611 | 9.09275 |
| 0.361033 | 0.331172 | -9.53663 | 8.43815 |
| 0.591441 | 1.35656 | -10.0676 | 7.77134 |

Fig. 6A

Fuel Pump ESA Results (.ESA) File Format text file (1 column X 2133 rows)

| | | Example |
|---|---|---|
| Header | month | 10 |
| | day | 22 |
| | year | 2002 |
| | pump type code | 1 |
| | prefix | 3 |
| | serial number | 0 |
| | flow rate (lb/hr) | 0 |
| | pressure (psi) | -1 |
| | sample rate (pps) | 25000 |
| | samples | 125000 |
| | probe mv/A | 100 |
| | probe mv/A | 100 |
| | location code | 3 |
| | position code | 8 |
| | DAQ VI version | 5.74 |
| | SCE battery (+V) | 6.46935 |
| | SCE battery (-V) | -6.50765 |
| | tail number | 60132 |
| | DAQ time during day (sec) | 50745 |
| | (future use) X 7 | 0 |
| | | 0 |
| | | 0 |
| | ↓ | ↓ |
| ESA Results | T1 phase RMS | 7.34859 |
| | T2 phase RMS | 7.48272 |
| | T3 phase RMS | 7.65332 |
| | neutral RMS | 0.495868 |
| | T1 phase stability | 3.42125 |
| | T2 phase stability | 3.28037 |
| | T3 phase stability | 3.35833 |
| | current unbalance (%) | 2.114 |
| | line frequency (Hz) | 400.2 |
| | estimated motor speed (Hz) | 118.4 |
| | delta orders in NF spectrum (0.05) | 0.05 |
| | NF spectrum array size (2000) | 2000 |
| | noise floor (NF) spectrum array magnitudes X 2000 | 3.41394E-22 |
| | | 7.57518E-22 |
| | | 9.13628E-22 |
| | ↓ | ↓ |
| | overall shorted turns magnitude | 1.89165E-05 |
| | overall static eccentricity magnitude (rotor bar based) | 0.0001014 |
| | overall dynamic eccentricity magnitude (rotor bar based) | 3.19215E-05 |
| | overall dynamic eccentricity magnitude (motor speed sideband based) | 0.000186191 |
| | overall rotor winding asymmetry magnitude (slip-poles sideband based) | 0.000803502 |
| | demod slip-poles peak | 0.000920767 |
| | demod 1 X motor speed peak magnitude | 0.000274156 |
| | demod 3 X motor speed peak magnitude | 8.85806E-06 |
| | demod 5 X motor speed peak magnitude | 0.000028227 |
| | motor speed harmonic magnitudes array (0 X to 85 X) | 0 |
| | | 5.35835E-17 |
| | | 4.81168E-18 |
| | ↓ | ↓ |

Fig. 6B

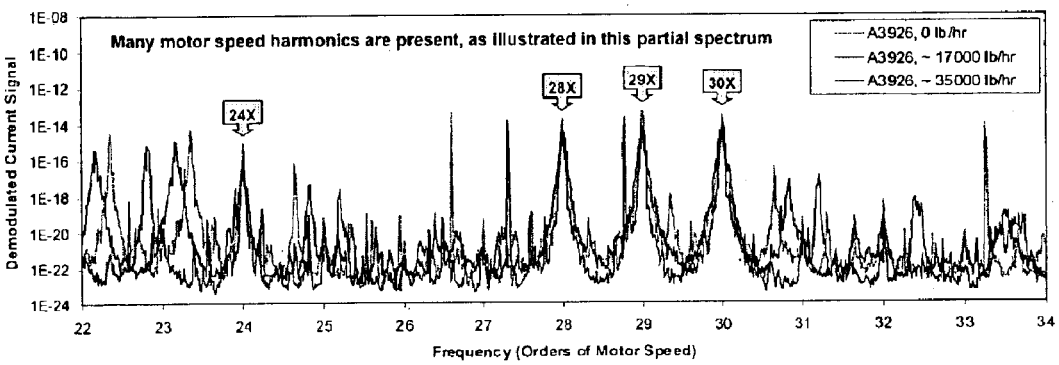

| ESA Parameter | Relationship With Auxiliary Pump And Motor Design |
|---|---|
| 1xMS, 2xMS | Fundamental and second harmonic of motor speed. |
| motor slip-poles | The magnitude of the slip-poles peak increases with motor rotor bar degradation. |
| 4xMS | The pump has 4 impeller vanes. |
| 6xMS, 12xMS, 18xMS, 24xMS, 30xMS, 36xMS | These harmonics represent multiples of 6x (the motor has 6 poles) or possibly a center frequency at 18x (the motor has 18 stator slots) that is modulated by 6x. |
| 28xMS, 56xMS | The motor has 28 rotor bars. 56 = 2 x 28 |
| 54xMS | 54 = 3 x 18, where 3 = number of motor phases, 18 = number of motor stator slots. |
| 84xMS | 84 = 3 x 28, where 3 = number of motor phases, 28 = number of motor rotor bars. |

Fig. 11

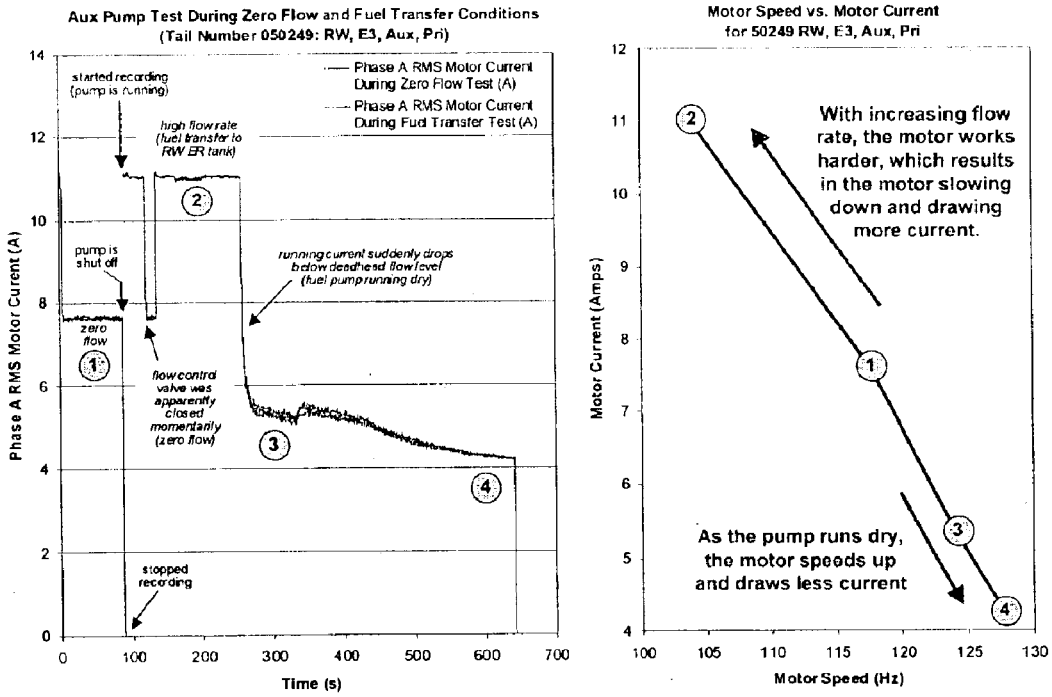

Fig. 12

ELECTRIC FUEL PUMP CONDITION MONITOR SYSTEM USING ELECTRICAL SIGNATURE ANALYSIS

STATEMENT REGARDING FEDERAL SPONSORSHIP

This invention was made with Government support under contract no. DE-AC05-00OR22725 to UT-Battelle, LLC, awarded by the United States Department of Energy. The Government has certain rights in the invention.

BACKGROUND OF THE INVENTION

The health of a prime mover, such as a pump, is a significant variable in high-reliability applications. The motor current signature of the electric motor driving a pump is a reliable indicator of the health of the electromechanical system, provided the signature is analyzed properly. In this general area known as electrical signature analysis (ESA), this technology includes special monitoring and processing of motor currents to determine characteristics of a motor, pump and its mechanical load. The motor takes electrical energy and converts it into mechanical energy to drive a mechanical load. Variations in the mechanical load and changes in the motor or pump condition are reflected in the motor current. By using special detection circuits and processing techniques, these small variations of motor current can be captured and analyzed. This information provides very useful and descriptive information about the conditions of the combined motor, pump and mechanical load.

The motor current contains motor current noise from various sources. It has been found that the motor current noise includes the sum of all the mechanical load changes which refer back to the electric motor drive and pump. Thus, motor current noise signatures taken at different periods during the operating life of the device help determine aging and wear or abnormal operating characteristics. The relative magnitude of the electric noise signal generated by a particular mechanical noise source will depend on its absolute magnitude and on its mechanical linkage to the motor which remains a fixed relationship for a given device. The motor itself acts as a transducer changing the mechanical load variations into electrical noise.

Currently, there is no easy, human friendly way to quickly check the status of a motor, pump and load using ESA. Typically, an ESA analysis requires examination of time and frequency domain plots. The equipment associated with such an analysis is not only bulky, expensive and time-consuming to use, but makes it virtually impossible to run a quick "health check" of a particular motor and load.

Furthermore, given the large amount of information held within the motor current noise signals, there is a need to provide high performance filtering circuits to improve ESA discrimination.

In general, some systems utilizing multiple motors do not have a stiff voltage source that is capable of maintaining a constant voltage irrespective of variations in any one of the motors. As a result, motor current signature analysis may identify a problem with a particular motor when in fact the problem arises from another motor in the same system. Consequently, a motor can be detected as having a broken bar or other defect, be taken off line, and then, on physical examination, be found to not have a defect. Signals representative of such false defect detections unpredictably appear and disappear and are sometimes referred to as "ghosts". These false indications of defects are often caused by the spurious signals generated in a typical weak voltage system such as may be found on aircraft, ships, locomotives or other vehicles utilizing on-board generated power. Accordingly, it would be advantageous to provide a device and method which enables identification and removal of motor current anomalies which are caused by spurious or ghost signals on the power system and not by fault conditions associated with the motor.

U.S. Pat. No. 5,578,937 to Haynes et al., herein incorporated by reference, teaches a method for diagnosing induction motors that requires a voltage signal and has no qualitative diagnostics indicative of the health of a prime mover (pump) associated with the induction motor.

U.S. Pat. No. 5,689,194 to Richards et al., herein incorporated by reference, teaches a motor current signature analysis system using a qualitative audio listening section and computer controlled frequency shifting/filtering with no qualitative diagnostics indicative of the health of a prime mover (pump) associated with the motor.

The publication, "Electrical Signature Analysis (ESA) As A Diagnostic Maintenance Technique for Detecting The High Consequence Fuel Pump Failure Modes"; D. E. Welch, H. D. Haynes, D. F. Cox, R. J. Moses; 6$^{th}$ *Joint FAA/DoD/NASA Conference on Aging Aircraft*, Sep. 16, 2002, herein incorporated by reference, provides more details on early work on this invention. More recent work on the invention resulted in additional references included herein.

BRIEF SUMMARY OF THE INVENTION

A pump diagnostic system and method comprising current sensing probes removably disposed on electrical motor leads of a pump for sensing only current signals on incoming motor power, a signal processor having means for buffering and anti-aliasing said current signals into a pump motor current signal, and a computer having a means for analyzing, displaying, and reporting motor current signatures from the motor current signals to determine pump health using integrated motor and pump diagnostic parameters.

BRIEF DESCRIPTION OF THE DRAWINGS

FIGS. 5A–5E are screenshots of the fuel pump data analysis.

FIGS. 6A and 6B are a listing of motor and test parameters used in the diagnostics.

FIG. 11 is a graph showing frequency components present in the demodulated spectrum and a table of their relationship with the pump and motor.

FIG. 12 is two graphs showing the relationship between motor current, speed, and running load.

DETAILED DESCRIPTION

Figure 1:
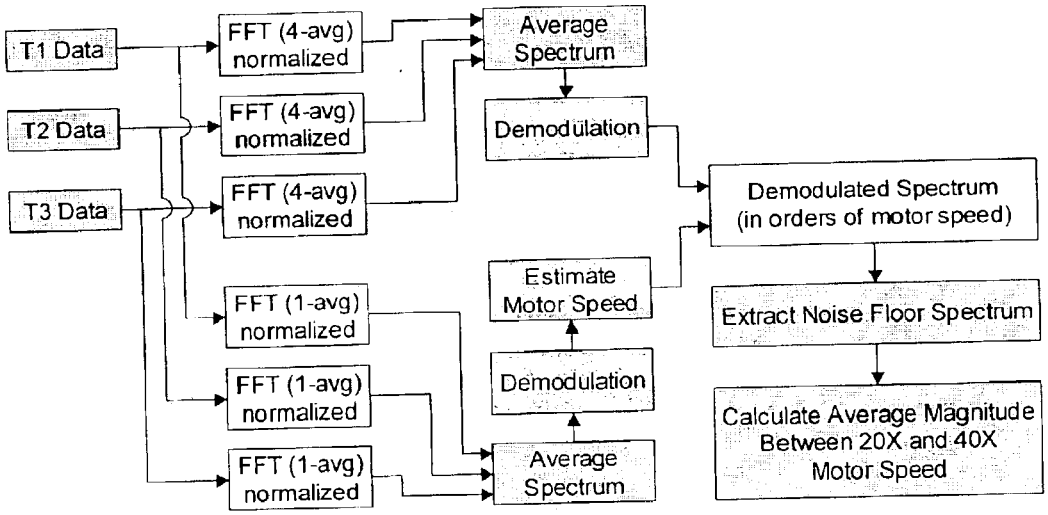
FIG. 1 is a simplified flowchart of the software functions used to determine fuel pump bearing condition.

The mission capable status of the C-141 cargo aircraft depends on many systems, one of which is the fuel delivery system. Fuel is delivered to the C-141 engines from the wing fuel tanks by means of twenty centrifugal fuel boost pumps, one primary and one secondary in each tank [four main tanks, four auxiliary tanks, and two extended range (ER) tanks]. The primary and secondary fuel boost pumps are submerged inside the wing fuel tanks. They operate on 115/200 VAC, 3-phase electrical current. The main fuel booster pump is deployed in the main tanks; the auxiliary fuel booster pump is installed in the auxiliary and ER tanks.

Presently, these fuel pumps are removed and replaced in the event of failure; failed pumps are routed to the Oklahoma City Air Logistics Center (OC-ALC) for repair. When a failure occurs, a significant out-of-service time occurs for the aircraft due to the need to order and receive replacement parts before repairs can be completed.

During recent experience, failure of fuel system booster pumps has accounted for over 4000 hours of aircraft unscheduled downtime per year. This equates to one aircraft being unavailable for nearly half a year. On average, the loss of airlift for this many days has a potential multi-million dollar negative impact annually on the Air Mobility Command's Transportation Working Capital Fund revenue. If the progress of these failures or malfunctions could be predicted or monitored in advance, their maintenance could be appropriately scheduled and their impact on operations could be minimized.

A C-141 fuel pump test facility was constructed at ORNL. Two test tanks were procured, one for auxiliary pumps and one for main pumps. Process water-cooling was used to eliminate fuel overheating during testing. The tanks are 24-in. tall×24-in. wide×44-in. long and are designed to contain 110 gallons of fluid. The pumps are inserted through an 11-in.×11-in. inspection port opening on the top of the tank.

An instrument control panel was constructed to operate the fuel pump test facility. This panel has digital readouts of fuel temperature, fuel pump outlet pressure, and fuel flow rate. In addition, both the auxiliary and main fuel pump power controls were routed through circuit breakers exactly as those used on the actual aircraft, so that problems similar to those that occur on an aircraft could be simulated with this facility.

A sample of pumps was acquired from the Aerospace Maintenance and Regeneration Center (AMARC) and OC-ALC for testing at ORNL. A total of 95 auxiliary pumps and 23 main pumps from AMARC were examined for defects in their "as-received" state. Those that showed no external damage were tested electrically using a megohmeter and a Baker Instruments Model 6A motor surge tester. The results of the forensic examinations of the fuel booster pumps from AMARC are shown in Table 1. OC-ALC provided ORNL with a sample of 50 C-141 Condition F auxiliary pumps and 42 C-141 Condition F main pumps. The results of the forensic examinations of the fuel booster pumps are shown in Table 1.

TABLE 1

| | AMARC pumps | | OC-ALC Condition F pumps | |
|---|---|---|---|---|
| Description | Main pumps | Auxiliary pumps | Main pumps | Auxiliary pumps |
| No apparent mechanical fault | | 45 | | 17 |
| Internal phase short | | 15 | | 5 |
| Missing parts | 1 | 16 | 1 | 2 |
| Foreign object damage (FOD) | | 9 | 15 | 13 |
| Will not fit scroll housing | | 4 | 23 | 11 |
| Loose front bearing, but runs | | 3 | | |
| Phases shorted to case | | 1 | | |
| Open windings | | | | 1 |
| Not tested | 22 | 2 | 3 | 1 |
| Total received | 23 | 95 | 42 | 50 |

Hydrodynamic performance curves of 12 main and 9 auxiliary reconditioned pumps tested at OC-ALC were generated. Six of the main and two of the auxiliary pumps failed the minimum pressure or flow requirements.

The hydrodynamic performance of 38 of the 46 AMARC pumps operable as received was measured. All of these pumps met the required minimum pressure and flow rate as prescribed by the Air Force technical operations manual.

To compare ESA field readings with laboratory readings, the effect of changes in phase voltage on an auxiliary pump's hydrodynamic performance was measured.

Figure 8:
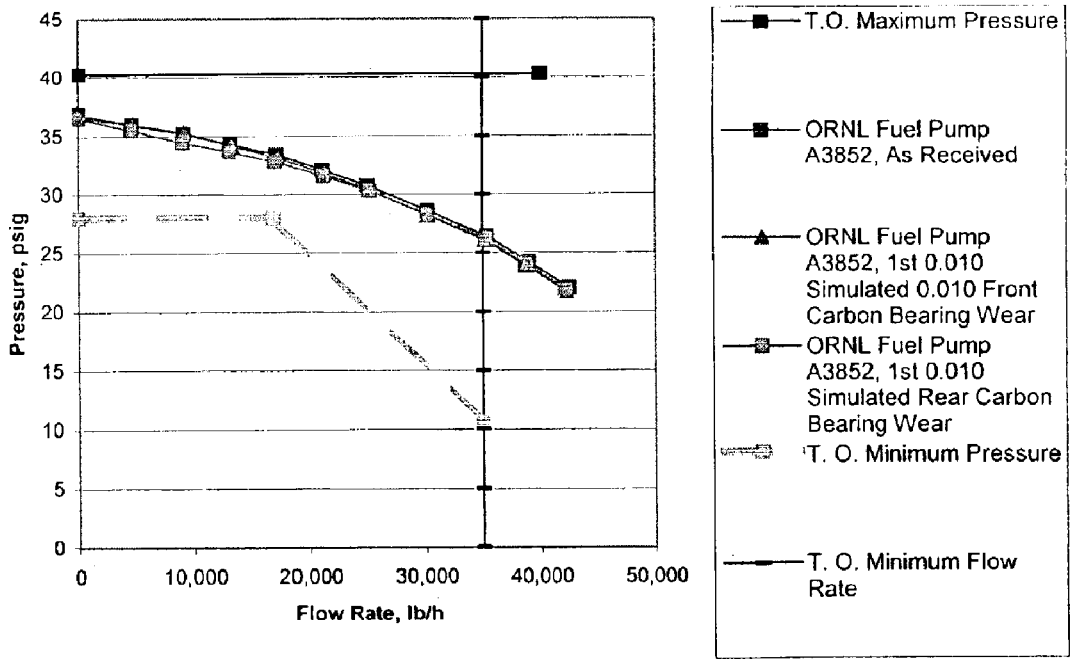
FIG. 8 is a graph showing no significant hydrodynamic performance difference between a healthy pump and those with simulated bearing wear.

To determine the effect on hydrodynamic performance due to insertion of increased front bearing clearance (simulating wear), the hydrodynamic performance of five pumps was measured both as received and after inserting one level of increased front and rear bearing clearance. The typical hydrodynamic response of these pumps is illustrated by one of the pumps shown in FIG. 8. As can be seen from FIG. 8, front and rear carbon bearing wear is not discernable using the standard test measurements.

The importance of an ESA-based monitoring method for C-141 fuel pumps is clear when one examines the C-141. Each aircraft utilizes a total of twenty fuel pumps, dispersed symmetrically ten per wing. Each wing contains five fuel tanks—two main tanks, two auxiliary tanks and one ER tank—with two pumps (a primary and a secondary pump) handling each fuel tank. C-141 fuel pumps are installed inside their fuel tanks and are intended to operate completely submerged in fuel. After installation, they are inaccessible for monitoring by conventional vibration instrumentation. ESA provides a unique means of monitoring fuel pump operational condition without requiring that anything be installed on the pumps themselves, and only requires access to electrical leads. The C-141 fuel pump leads can be easily accessed under the wings and inside the fuselage. At these locations, fuel pump current signals are obtained using clamp-on current probes that can be removably clamped around live conductors without special precautions and without interrupting any aircraft operations. The current probe output leads are connected to data acquisition equipment, which only needs to operate for a few seconds. The clamp-on current probes are then removed, leaving the aircraft's wiring as it was found before data were acquired.

Figure 3:
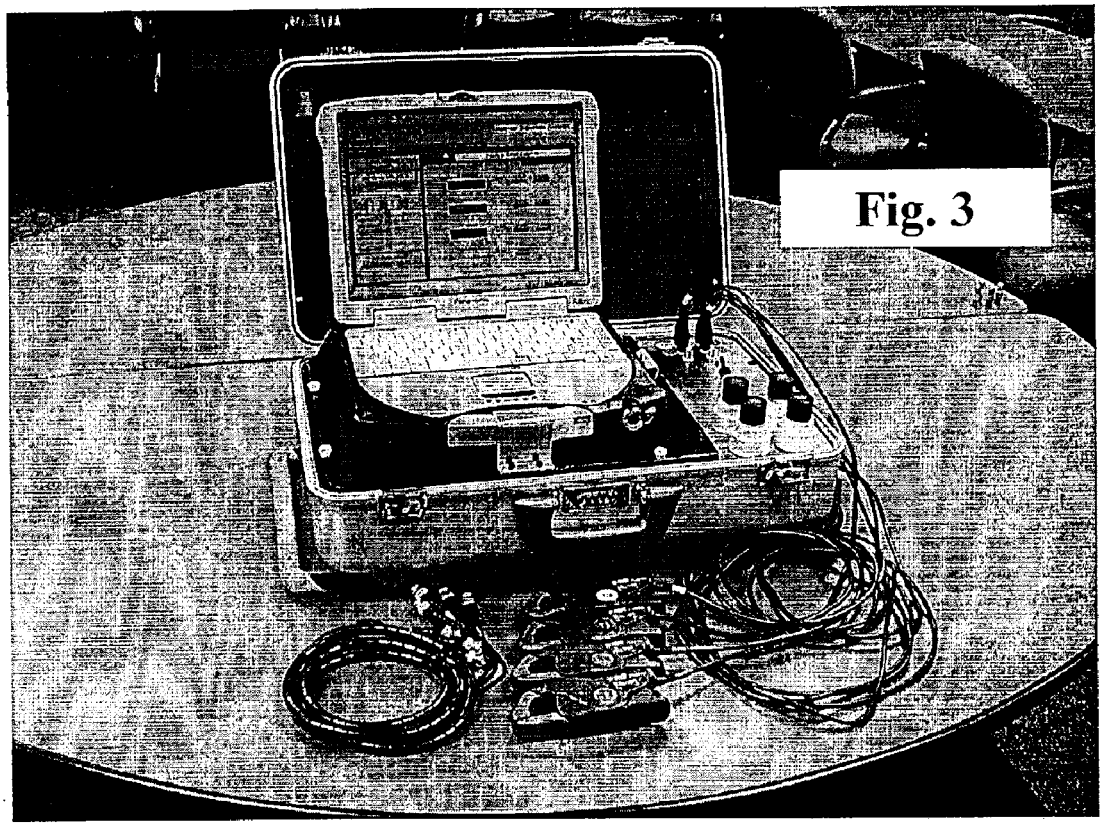
FIG. 3 is a photograph of the fuel pump condition monitor system.
Figure 4:
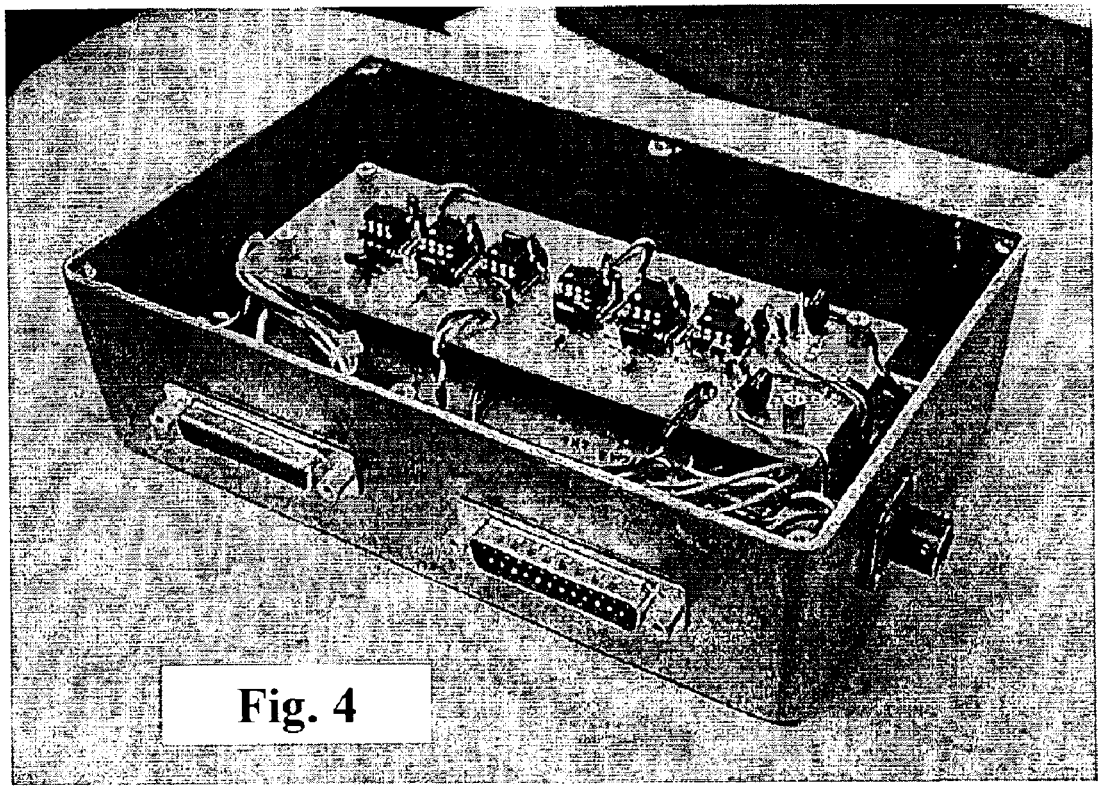
FIG. 4 is a photograph of the systems signal conditioning box.
Figure 5A:
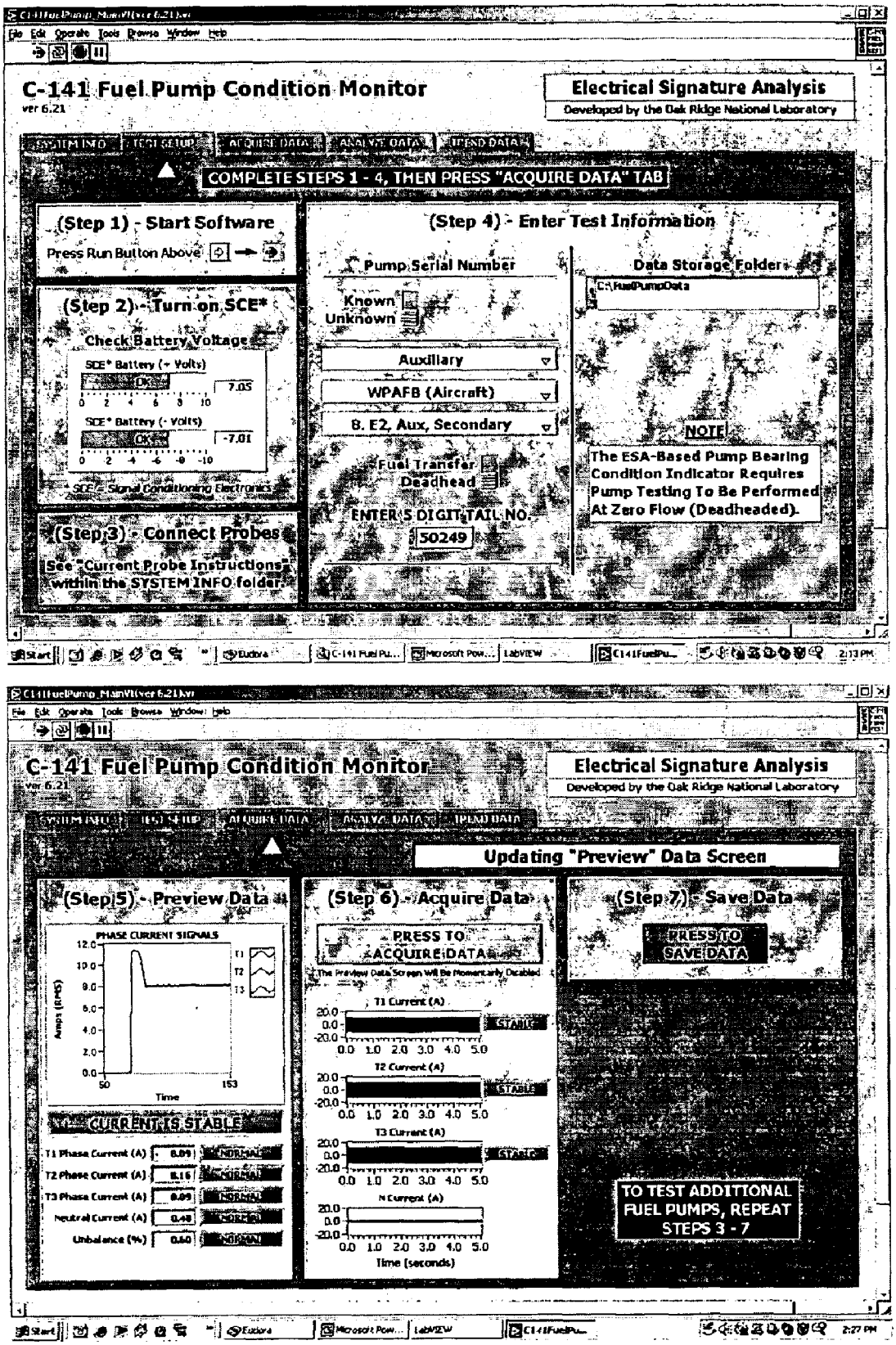
Figure 5B:
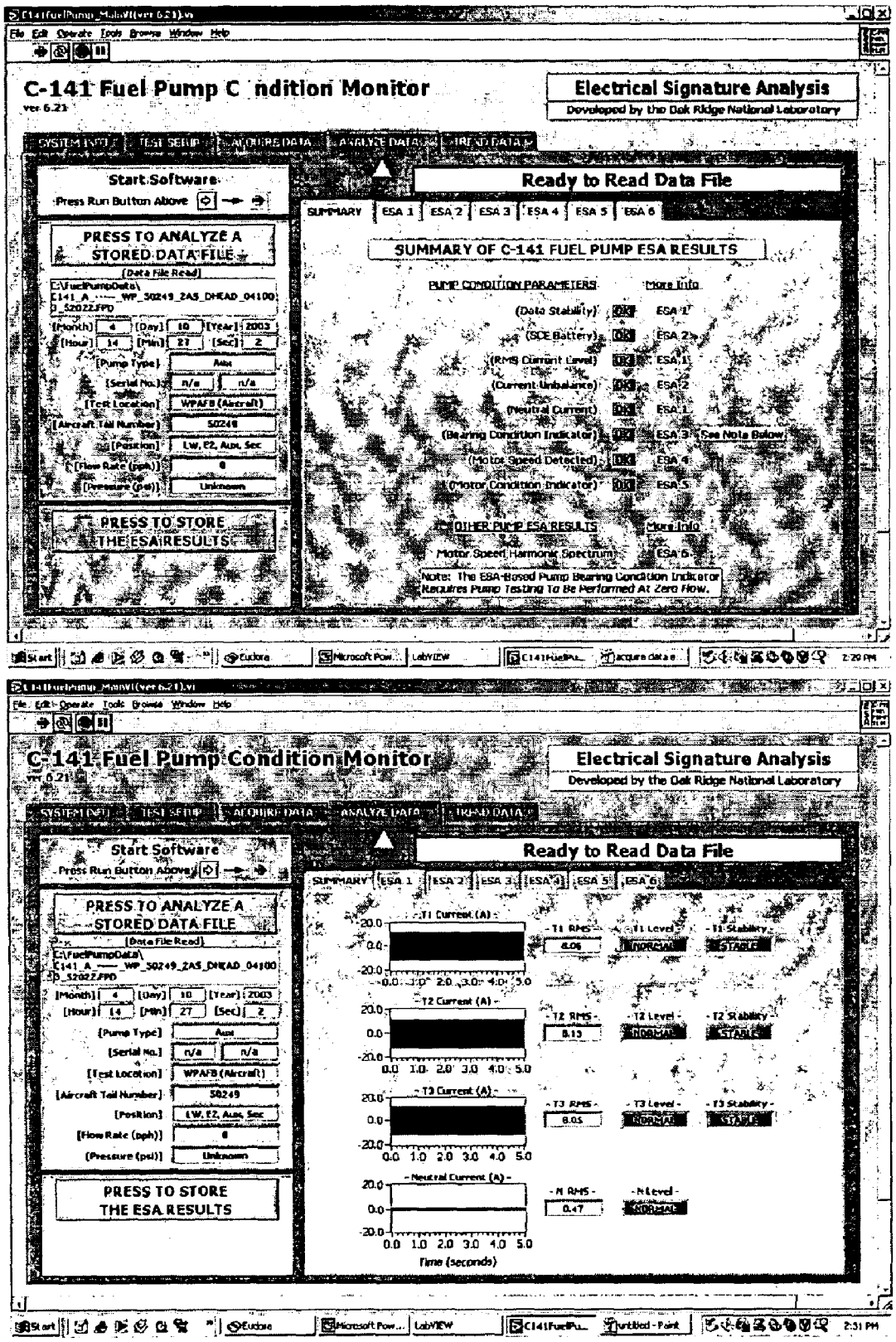
Figure 5D:
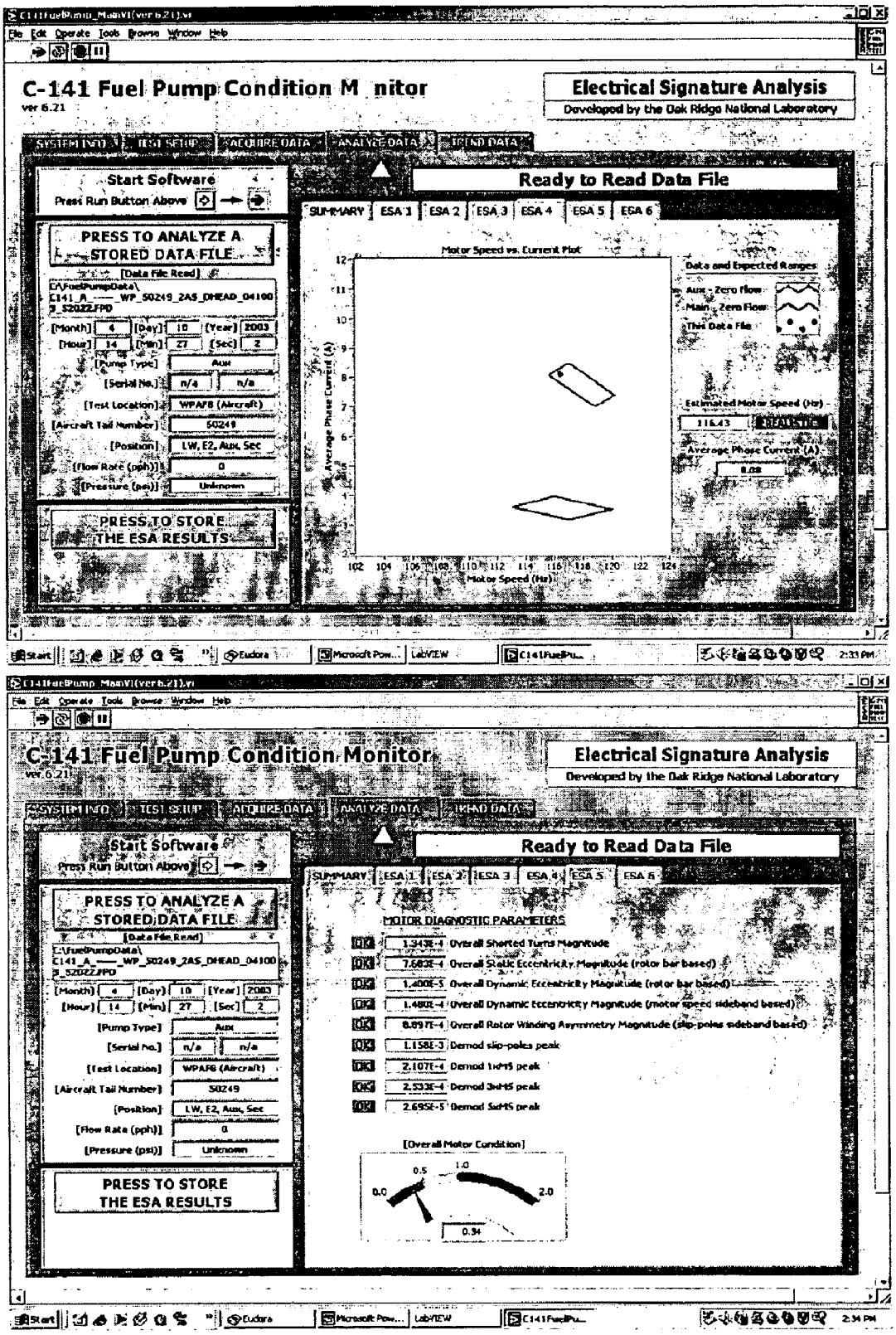
Figure 5E:
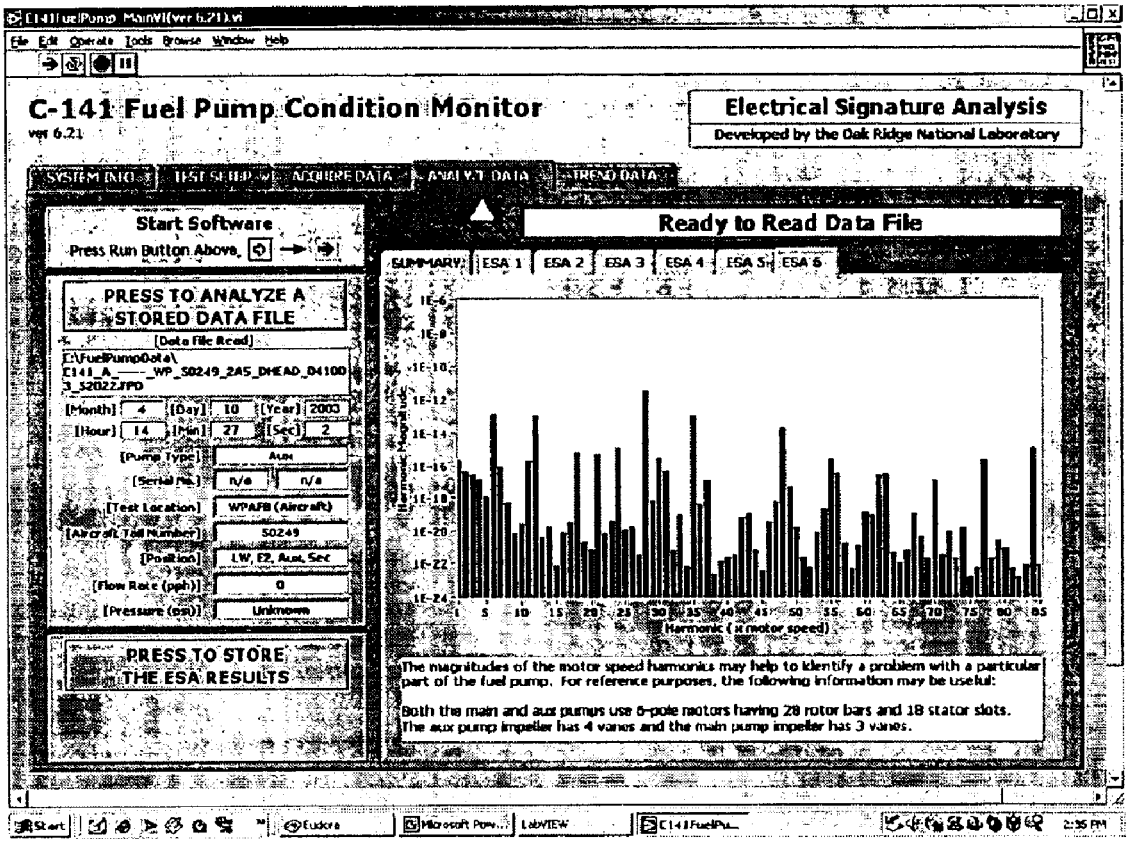
Figure 7:
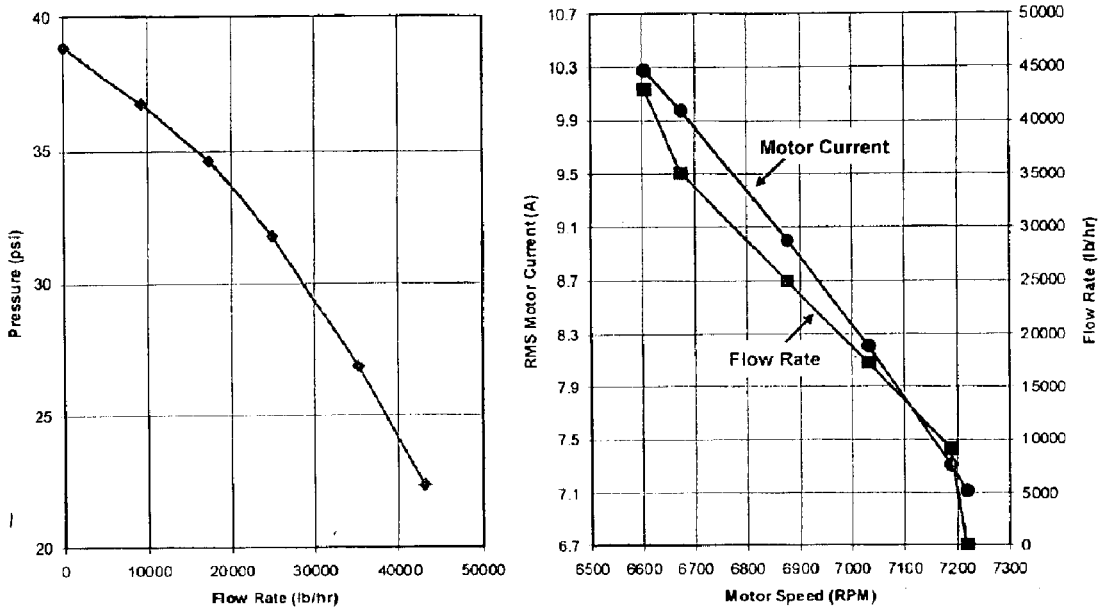
FIG. 7 is two plots showing the relationships between several auxiliary fuel pump parameters.

To provide a consistent platform for obtaining and analyzing fuel pump electric current data, a portable system was developed. This system, shown in FIGS. 3 and 4, includes clamp-on probes (AEMC® Instruments model MN261) for sensing current in all three pump electrical phases plus neutral, signal conditioning electronics for signal buffering and anti-alias filtering, and a portable computer running several virtual instruments (VIs) that are based on LabView™, a commercially-available software development system. Each current probe has two arrows embossed on it, one on the top of the probe and one on the bottom. It is recommended that each current probe be clamped on its motor lead so that the arrow points toward the fuel pump and away from the pump's power source. A "suitcase-style" embodiment of the ESA-based diagnostic system has all of the fragile components encased in a military standard suitcase for extra durability. This system is expected to serve as a platform for other potential aircraft diagnostic applications such as flight control surface drive actuators, landing gear bay door actuators, integrated drive generators, etc. At the end of the project, two prototype ESA systems will be delivered to the Air Force for their use on C-141 fuel pumps.

Figure 9:
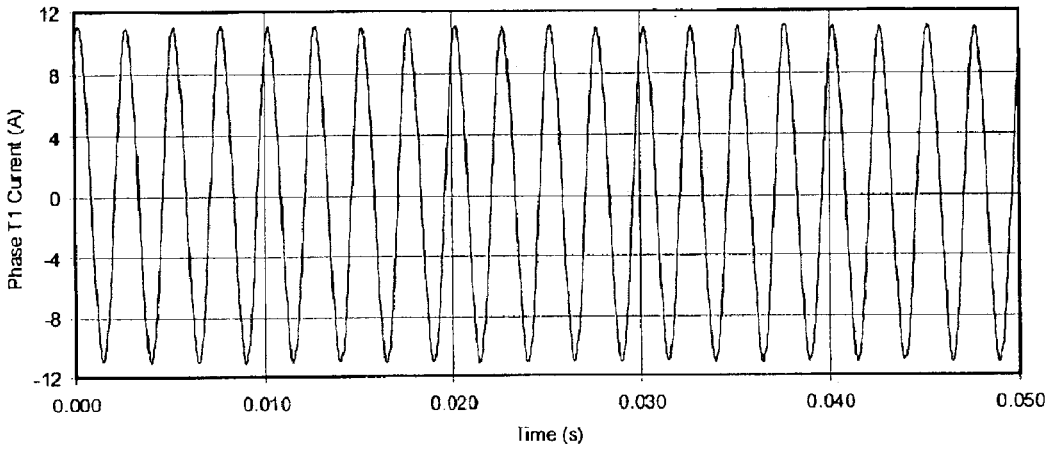
FIG. 9 is a graph showing a typical auxiliary fuel pump motor current waveform.

C-141 fuel booster pump hydrodynamic performance and electrical signature data were obtained from three locations: OC-ALC (pumps in test stands), Wright-Patterson Air Force Base (WPAFB) (pumps installed on aircraft), and a test loop constructed at ORNL. FIG. 9 shows a typical auxiliary fuel pump motor current waveform. It is a rather normal-looking 400 Hz sinusoid that reveals very little of what is contained in it.

Figure 10:
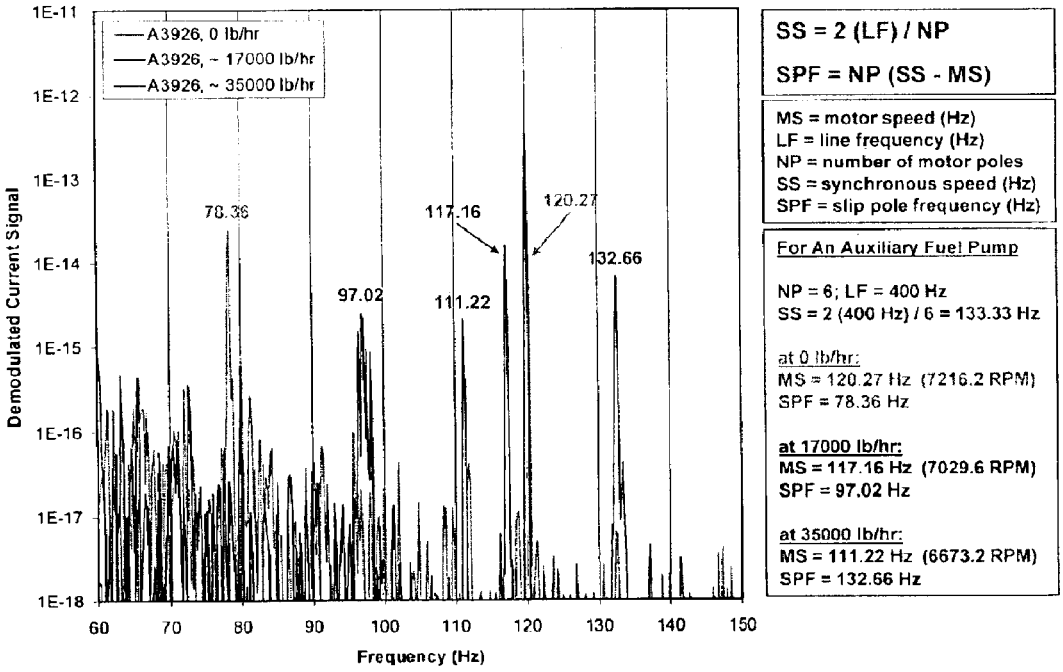
FIG. 10 is a graph showing key frequency components discovered at the fundamental speed and slip-poles frequency of the auxiliary fuel pump motor.

The complexity of the motor current spectrum makes it difficult to analyze in its "raw" state. One reason for the complexity is that a single periodic perturbation, or modulation to the 400 Hz line frequency will result in a pair of peaks based on the frequencies of the line frequency and modulation. A way to simplify the spectral contents is to demodulate the spectrum using either analog or digital (e.g., via software) methods. The virtual instrument (VI) used for analyzing the fuel pump motor current signals employs a digital amplitude demodulation method, which results in spectral sideband consolidation and effectively simplifies the motor current spectrum for analysis. After demodulation, key frequency components were discovered at the fundamental speed and slip-poles frequency of the auxiliary fuel pump motor as shown in FIG. 10.

It was found that for most auxiliary fuel pumps, motor speed can be determined directly from the demodulated motor current spectrum with a fairly high confidence. The frequency of all other spectral peaks may then be represented in orders of running speed. Frequency components having an integer order are harmonics of motor speed. Their harmonic number then provides a clue as to their origin, when key design details of the fuel pump are taken into consideration. For example, FIG. 11 shows that a frequency component is present in the demodulated spectrum at 24-times (24×) running speed. Other peaks shown in this figure are at 28×, 29×, and 30×. The figure lists major frequency components (ESA parameters) that are found in the auxiliary fuel pump motor current spectrum and their possible relationship to pump and motor design.

In addition to frequency spectrum analysis, fuel pump hydrodynamic performance curves can characterize the relationships that exist between measurable parameters, such as flow rate, discharge pressure, motor running current, and motor speed.

The relationships between flow rate, motor current and motor speed is well illustrated by a test that was carried out at WPAFB on an auxiliary fuel pump that was transferring fuel from the engine three primary fuel tank to the extended range tank in the same wing. FIG. 12 shows that before the fuel transfer began, the auxiliary fuel pump was operated at deadhead conditions (zero flow), where the pump's running current was approximately 7.6 amps. During the fuel transfer, the running current rose to approximately 11 amps. After a little more than two minutes into the transfer, the motor current precipitously dropped to less than 6 amps, and eventually the pump was shut off after the running current had dropped to nearly 4 amps. As illustrated by the figure, increasing flow rate causes the pump motor to work harder, which results in the motor slowing down and drawing more current. Conversely, as the pump apparently runs dry, the motor speeds up and the current drops to levels below that which is observed at zero flow. This indicates that even at deadhead conditions, the fuel pump sees more mechanical load than when the pump's impeller no longer feels the drag of the surrounding fuel. The relationship between motor current, speed, and running load that is observed at this macro level is also seen at a much smaller micro level when much smaller changes in running load occur.

The real value of ESA is as a non-intrusive technology for detecting these small-effect degradations in electromechanical components and systems. Degradations can often be detected as a change in frequency or magnitude of a single spectral component, which may easily represent less than one percent of the entire motor current signal. Changes in motor current at these levels can never be detected in the overall RMS motor current magnitudes, but require detailed spectrum analysis of raw or demodulated signals.

In order to develop ESA as a fuel pump diagnostic technology, it was desired to test fuel pumps in both typical operational condition and in degraded condition, where the type and level of the degradation were known. Using a fuel pump test facility that is capable of testing both main and auxiliary fuel pumps, these tests were done. The types of degradation common to C-141 fuel pumps were determined from several discussions with maintenance personnel.

The degraded conditions observed in C-141 fuel booster pumps include:

foreign object damage (FOD),
axial thrust washer wear,
impeller/shroud blow by,
motor electrical degradation,
impeller imbalance due to nicks or abrasion,
front carbon bearing or journal wear, and
rear carbon bearing or journal wear.

From this list, bearing wear was selected as the first degradation to study. Ninety-five auxiliary fuel pumps were obtained from AMARC. The fuel pumps were disassembled and carefully inspected prior to flow facility testing. An inspection of the auxiliary pumps from AMARC showed that front bearing wear is more common than rear bearing wear, since the clearance between the front carbon bearing and the front journal was in almost all cases greater than the rear bearing/journal clearance.

Based on this evidence, it was decided to focus on front bearing degradation. To determine if ESA methods could detect front bearing wear, five auxiliary fuel pumps were tested in "as-received" condition and after increasing the front bearing internal diameter about 0.010-inch. An examination of the hydrodynamic performance curves for the five pumps showed that they did not provide a reliable means of detecting the additional bearing wear.

Efforts were then focused on developing an ESA technique that could quickly detect bearing wear in fuel pumps that are installed in flow test loops and in C-141 aircraft. An ESA-based method that could detect fuel pump bearing wear at deadhead (zero flow) conditions would be particularly beneficial since:

An ESA-based method would only require access to the motor power leads.

Zero flow conditions are easy to establish on an aircraft while on the ground.

Although a significant fuel pump flow rate can be established (from tank to tank transfers), zero flow testing is less intrusive.

An ESA diagnostic method that can be used at zero flow is more "robust" than a method that is sensitive to flow-rate variations.

Figure 13:
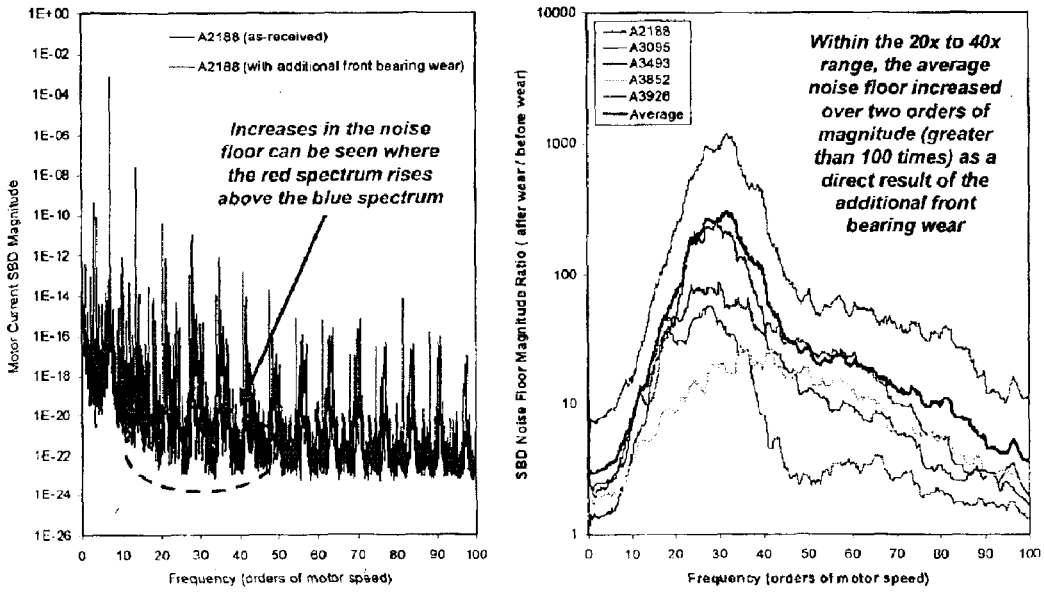
FIG. 13 is two graphs explaining what is referred to as the noise floor.

After considerable study, it was determined that the best indicator of front bearing wear in the motor current spectrum was not a specific frequency peak, but was the base, or floor of the spectrum. The noise floor of the demodulated motor current spectrum at deadhead conditions was observed to increase in all five pumps having the degraded front bearings. FIG. 13 graphically explains what is referred to as the noise floor. This figure also shows that the increase in the noise floor was especially prominent within a range bounded by 20-times motor speed and 40-times motor speed (20×–40×). Within the 20×–40×range, the average noise floor increased over two orders of magnitude (greater than 100 times) as a direct result of the additional front bearing wear.

When all other auxiliary pumps are added to this plot, a few pumps that were tested at WPAFB and at OC-ALC were seen to exhibit the high noise floor levels that are indicative of front bearing wear, although the front bearing clearances of these pumps are not known.

Figure 14:
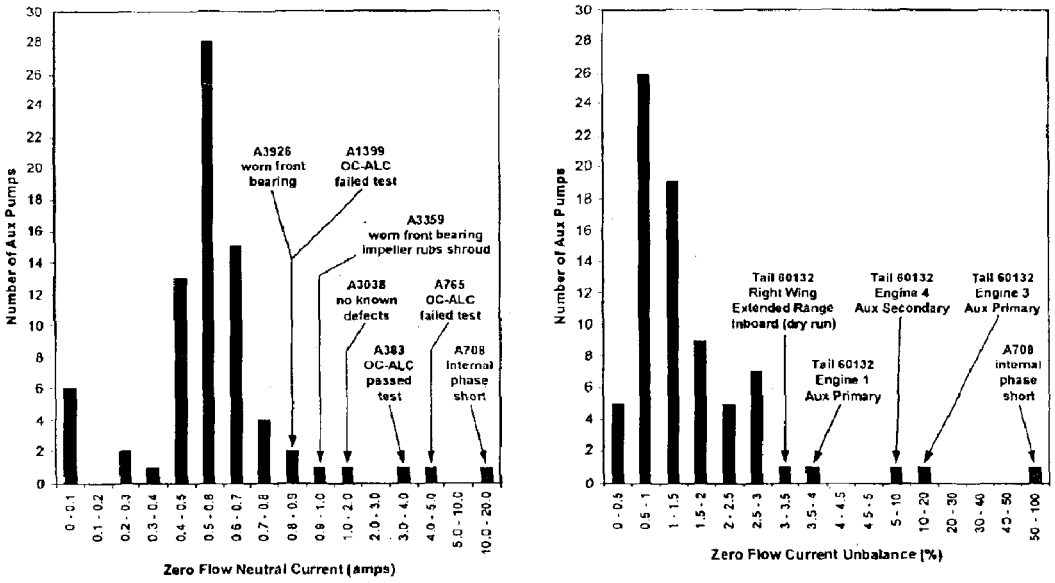
FIG. 14 is two bar charts showing the distribution in neutral current and current unbalance for auxiliary pumps tested at zero flow.

Since motor electrical degradation is also a concern, several measurements were made that might expose differences in condition between the motors used in the auxiliary fuel pumps that have been tested so far. FIG. 14 shows the distribution in neutral current and current unbalance for all tested auxiliary pumps at zero flow. Several pumps having unusually high neutral current were also identified as having other problems (e.g., worn front bearings, failure to pass OC-ALC pressure-flow criteria). Several pumps tested on aircraft 60132 were also observed to have unusually high current unbalance. Only one known motor electrical problem was present in this population: the internal phase short in AMARC pump A708. This failure adversely affected both the neutral current and current unbalance measurements in an easily detectable way.

Figure 15:
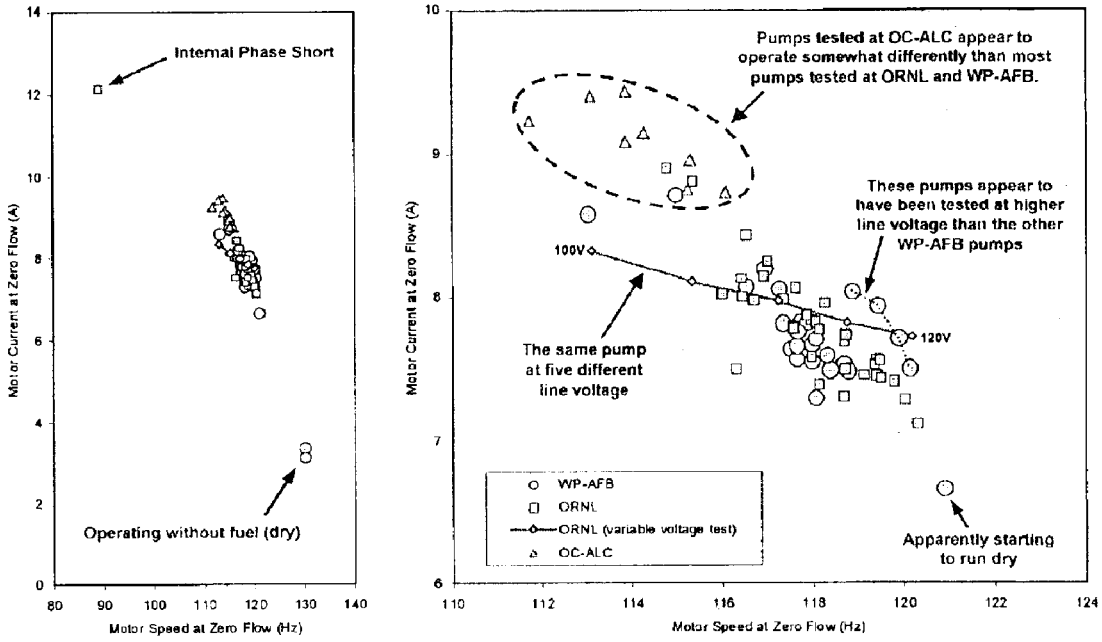
FIG. 15 is two graphs showing motor speed and motor current for auxiliary pumps tested at zero flow.

FIG. 15 is presented to show motor speed and motor current for all auxiliary pumps tested at zero flow. The relationship between these two parameters is sensitive to changes in running load that can occur for many reasons, such as inadvertent flow (e.g., from leakage between the pump and scroll housing), lack of fuel (dry running), and friction or binding due to mechanical degradations.

Several points can be made by this one figure:

Most pumps are generally grouped together, while the outliers represent undesirable conditions: one pump having an internal phase short and two pumps operating without fuel (dry).

The fuel pumps tested at OC-ALC appear to operate somewhat differently than most pumps This has been attributed to their use of a fuel pump support stand (not used in aircraft) that resulted in increased running loads to the pump motor, leading to decreased running speeds and increased running currents.

Changes in line voltage for a given pump operating at zero flow will result in a shift in the motor speed vs. current relationship. Line voltage variations produce a pump response that may be distinguished from a load variation.

Four pumps tested at WPAFB appear to have been tested at slightly higher (~5 V) line voltage than most other pumps. These pumps had been tested on an aircraft in the flight line, rather than on aircraft in the hanger, as other pumps were.

Although all tests were supposedly performed at zero flow, the scatter between the data suggests that some pumps may have had fuel leaking between the pump housing and the scroll housing, or may have had mechanical problems. In either case, the motor loading would have increased, resulting in increased current and lower running speed.

Electrical signature analysis (ESA) is a powerful technology for condition monitoring, diagnostics, and prognostics of electromechanical equipment. ESA is a non-intrusive technology that exploits the abilities of electric motors and generators to act as transducers. As such, the motors and generators provide signals that are similar to those provided by accelerometers. By using a multitude of signal processing and signature analysis techniques, one can use ESA to enhance equipment safety, reliability, and operational readiness by providing improved diagnostics and prognostics.

Many auxiliary pumps were obtained from AMARC, carefully inspected, and tested. In addition to examining and testing auxiliary fuel pumps in their "as received" state, five of these pumps were further degraded with 0.010-inches of additional front bearing wear and retested. Considerable data analyses led to the development of this new capability for detecting front bearing wear in C-141 auxiliary fuel pumps based on the measurement of the demodulated motor current spectrum noise floor obtained at zero flow. This new method is a reliable means of detecting excessive front bearing wear on pumps tested in flow test facilities and on C-141 aircraft. Motor electrical failures are also easily detected.

The ESA platform is also amenable to other applications such as fuel pumps on other aircraft and on additional components and systems (e.g., generators, generator-connected equipment, integrated drive generators, aircraft constant speed drives, electric motors, active synchrophasers, motor-driven actuators for control surfaces and other components) used by the Air Force and other organizations.

A series of five AMARC auxiliary fuel booster pumps were tested in their as-received condition after the imposition of a number of implanted fault conditions. Conditions of fuel pump operation that could be expected to degrade over time and that could be simulated were identified as front journal wear, rear journal wear, rear axial thrust washer wear, front carbon bearing wear, and rear carbon-bearing wear.

The first implanted fault condition was an increase of 0.010-in. front carbon bearing clearance, simulating that due to mechanical wear. The test results show that, with one exception, there is very little impact on the pressure vs. flow output curve of auxiliary pumps after insertion of 0.010-inch-diametral wear, including the minimum pressure at given flow rates or the maximum flow rate. The results show that these pumps continued to meet the pressure vs. flow rate requirements after insertion of the 0.010-inch-diametral wear in the front carbon bearing.

To provide a consistent platform for obtaining and analyzing electric current data from fuel pumps tested at ORNL, OC-ALC, and WPAFB, a portable system was developed. This system, shown photographically in FIG. 3 and schematically in FIG. 2, includes clamp-on probes for sensing electric current in all three electrical phases plus neutral, signal conditioning electronics for signal buffering and anti-alias filtering, and a portable computer running several virtual instruments (VIs) that are based on LabView™, a commercially available software development system. A photograph of the signal conditioning box is provided in FIG. 4.

A computer screen display of the data acquisition VI provides a continuous RMS magnitude chart of the four current channels (three phases plus neutral), displays of the acquired data, and a data quality check to assure that only data that are free from large transients are saved. The VI provides a means for saving the "raw" data and other relevant pump test information.

Once data have been acquired, the resulting data file can be read and processed by the data analysis VI, shown in FIG. 5A–5E. This VI provides a digital demodulation algorithm and a novel means of automatically determining the pump's operating speed solely from the current signature. The VI also provides an orders-based spectrum analysis display and extracts a set of trendable signature parameters that have been shown to have potential diagnostic significance. FIGS. 6A and 6B provide a list of parameters stored by the data analysis VI.

Using the ORNL fuel pump test facility, five auxiliary pumps were initially tested in as-received condition, and then retested after their front bearings had their clearance enlarged by approximately 10 mils (0.010 inches).

The additional bearing wear had a noticeable, but inconsistent effect on the pumps' hydrodynamic (pressure vs. flow) performance curves. For example, the wear did not produce any significant change in hydrodynamic performance for pumps A3493 and A3852, but lowered the pressure about four percent on A3095, seven percent on A3926, and over fifteen percent on A2188. The significant variation in pressure change suggests that hydrodynamic performance might be sensitive to, but probably not a reliable indicator of front bearing wear.

Figure 16A:
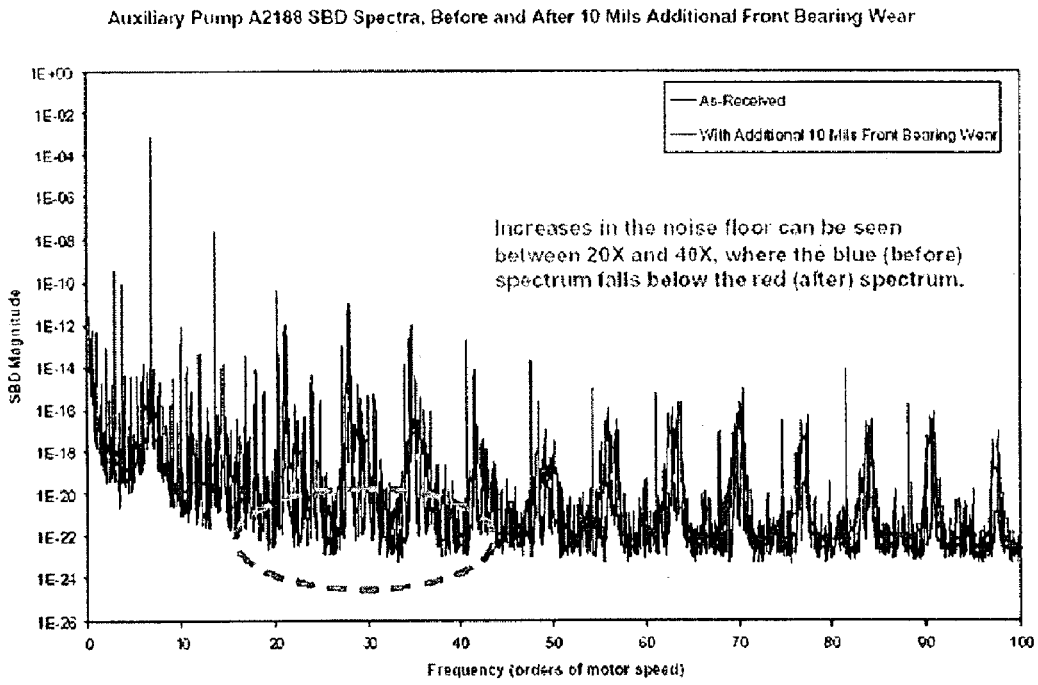
FIG. 16A is a graph showing that the bottom of the spectrum (noise floor) moved up within the approximate range of 20-times to 40-times motor speed, as a result of 10 mils additional front bearing wear on pump A2188.

In contrast, examinations of the zero-flow demodulated electric current noise floor revealed profound, repeatable indications of the front bearing wear. FIG. 16A shows that the bottom of the spectrum (noise floor) moved up within the approximate range of 20-times to 40-times motor speed, as a result of 10 mils additional front bearing wear on pump A2188. The noise floor was automatically extracted for careful comparisons, using a VI developed for this purpose. Using these VIs, the shift in noise floor that accompanied the front bearing wear on each of the five degraded pumps was measured. These plots better reveal the noise floor range most sensitive to front bearing wear: 20× to 40×. For this range, the average noise floor increase for the five degraded pumps was over two orders of magnitude (greater than 100 times) as a direct result of the 0.010-inches of additional front bearing wear.

Being able to detect fuel pump degradation at deadhead (zero-flow) conditions is desirable since zero flow conditions are easy to establish on an aircraft while on the ground. Although a significant fuel pump flow rate can be established (from tank-to-tank transfers), testing at zero-flow is less demanding. In addition, deadhead conditions produce the highest discharge pressure and thus provide the best opportunity to detect leakage associated with pump/shroud mounting problems.

Particular attention was thus directed towards the zero-flow noise floor spectra for all tested pumps. There is a clear correlation between front bearing clearance and the magnitude of the noise floor components, especially in the 20× to 40× range.

Figure 16B:
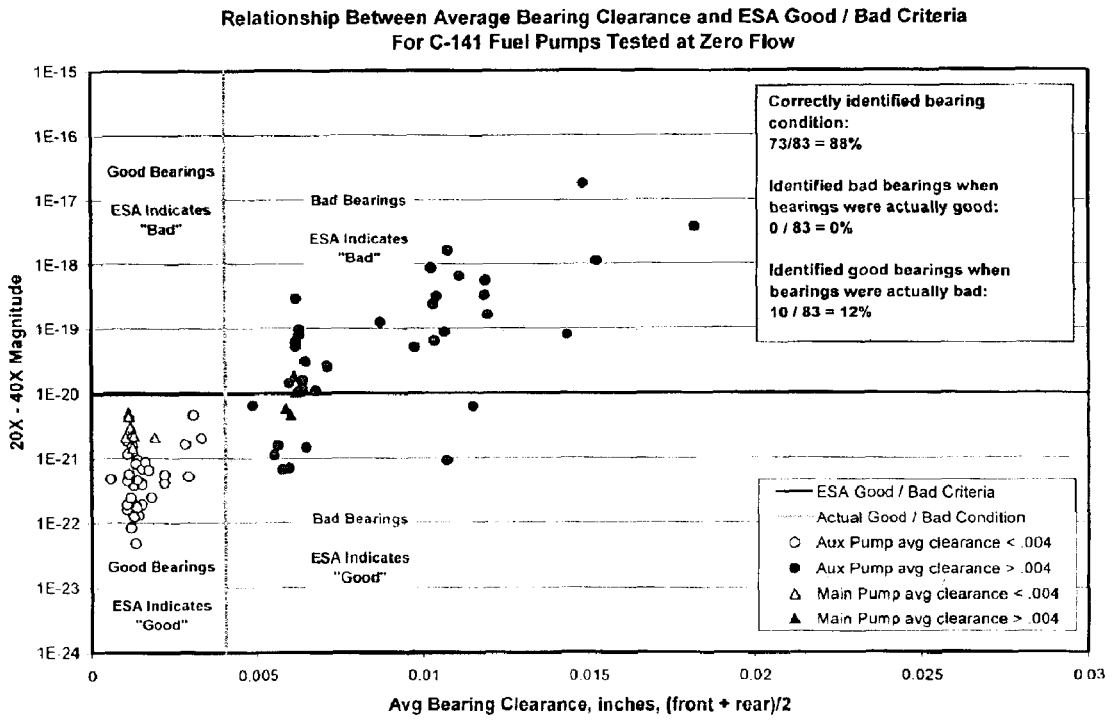
FIG. 16B is a plot showing the relationship between average bearing clearance and noise floor magnitudes.

FIG. 16B shows the 20× to 40× noise floor magnitudes for aux pumps tested at ORNL. The figure shows that the fuel pumps having the greatest noise floor readings also had the greatest bearing wear (clearance).

Figure 17:
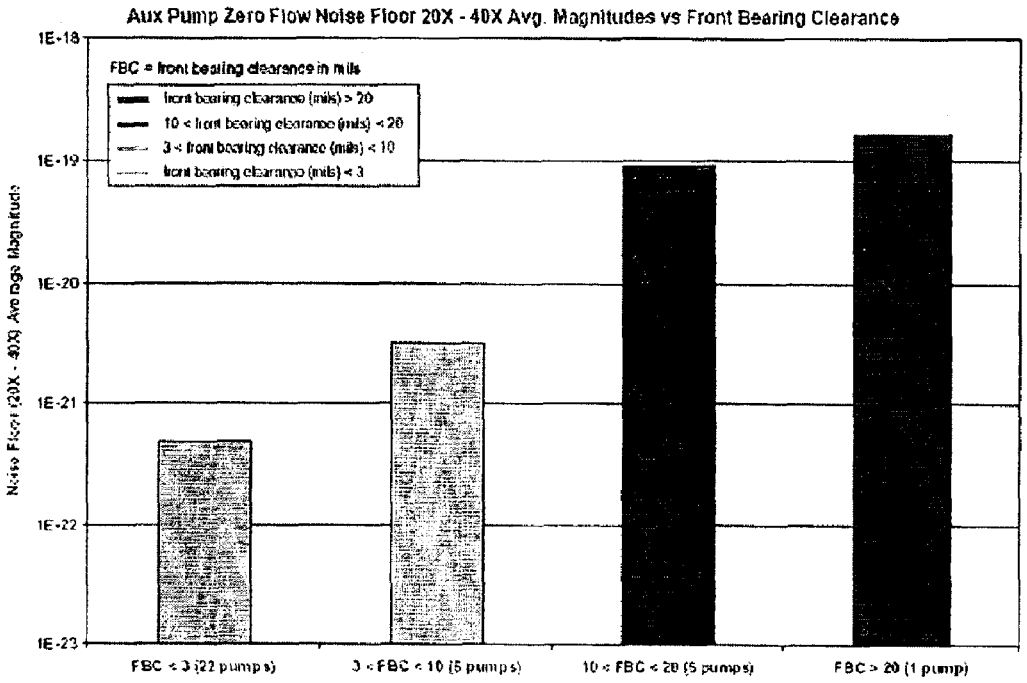
FIG. 17 is a bar graph showing the no-flow noise floor magnitudes for different front bearing clearances.

FIG. 17 summarizes the relationship that has now been developed between the zero-flow 20× to 40× noise floor magnitudes and the front bearing dimensions of pumps tested at the ORNL fuel pump test facility. Knowing the front and rear bearing dimensions now allows plotting noise floor magnitudes vs. front bearing clearance. These figures establish the basis for using noise floor measurements as an indicator for auxiliary fuel pump front bearing wear. Since this ESA-based method may be performed on pumps that are installed on aircraft as well as in flow test facilities, and since it appears to be more consistent than hydrodynamic performance testing in discovering bearing wear, it offers a breakthrough in condition monitoring for C-141 fuel pumps.

Although no correlation was found between the zero-flow noise floor measurements and line voltage variations, it is important to realize the profound impact on hydrodynamic performance that results from operating an auxiliary fuel pump at different than nominal line voltage (115 volts). Although line voltage can be measured directly at a test facility, it can be difficult to make this measurement on an aircraft. Since motor speed can be obtained from the motor current signal, the relationship between speed and current can be determined nonintrusively and used to indirectly verify correct line voltage, or identify when line voltage has changed. This method was used to identify a possible variation in line voltage between different tests performed at WPAFB.

A simplified flowchart of the software functions used to determine fuel pump bearing condition is shown in FIG. 1. T1 Data, T2 Data, and T3 Data are the three phase current signals that were obtained by the FPCM system in the "data acquisition" mode. The neutral current signal, also acquired during data acquisition, is not analyzed in the manner shown below. A frequency spectrum is determined from each of the three phase current signals (T1, T2, and T3) and normalized, by dividing the absolute spectral magnitudes by the magnitude of the largest peak (which is always the power line frequency, and is 400 Hz in this case). This normalized spectrum is called the "raw" spectrum. Demodulation is performed via software using a method called sideband demodulation (SBD). This involves examining the "raw" spectrum and locating the largest peak in the spectrum (which acts as the "carrier" of modulation frequencies) and searching for pairs of peaks that are equidistant from the carrier peak. These pairs of peaks are called "sidebands" and their distance from the carrier peak is the modulation frequency.

Modulation sidebands will be present when the magnitude of the fuel pump motor current signal is periodically varied (modulated) as a result of (a) a significant mechanical load variation, such as from a bad bearing, and/or (b) a significant motor degradation, such as rotor winding asymmetry.

Demodulation using the SBD method takes into account the fact that as the modulation frequency increases, and the sideband spacing increases, the lower sideband peak will eventually reach the 0 Hz (DC) border, and "bounce back," and continue in the same direction as the upper sideband is moving, but at a frequency that is less than the upper sideband by exactly two times the carrier frequency.

The SBD method scans for all possible modulation frequencies by locating the significant sideband pairs. It does this by multiplying the magnitudes of the upper and lower sidebands. A relatively large product is indication of a relatively strong modulation frequency.

The SBD process ultimately creates a demodulated spectrum, whose frequency scale is in cycles per second (Hz). To make this spectrum more relevant to fuel pump diagnostics, the frequency scale is adjusted to read in multiples of motor speed.

Before this can be done, of course, the motor speed must be determined. The software determines motor speed automatically. Determining motor speed from motor current, automatically, is an essential element of the invention.

To determine motor speed, the demodulated spectrum is first filtered by removing peaks that are located at several multiples of the carrier frequency (which is the 400 Hz line frequency for aircraft fuel pumps). After filtering out the line frequency harmonics, the software looks for the strongest series of peaks that fits the motor speed harmonic pattern that has been empirically determined from considerable fuel pump data analyses. This pattern consists of the following motor speed harmonics: 1×, 6×, 12×, 18×, 24×, 28×, and 84. The base frequency that produces the strongest series of these harmonics is the motor speed. This method has proven to be very reliable and is key to most of the frequency-based analyses performed by the system.

The noise floor is a specially filtered version of the demodulated spectrum. The noise floor spectrum contains no significant individual peaks, but retains the profile of the bottom (floor) of the demodulated spectrum. It was discovered that this floor changed when defective bearings were present. This most pronounced change in the noise floor due to bearing degradation occurred in a frequency band bounded by two multiples of motor speed: 20× and 40×. Thus the average noise floor magnitude between 20× and 40× correlated well with the condition of the fuel pump bearings. Based on many test cases, a criterion was established for determining bearing condition from this noise floor measurement as follows:

| Bearing Condition | Average Noise Floor Magnitude Between 20× and 40× Motor Speed |
|---|---|
| Bad | >1 E−20 |
| Good | ≦1 E−20 |

The motor condition is expressed as a single overall indicator and also as nine individual motor diagnostic parameter measurements as described below. The nine motor diagnostic parameters used by the FPCM software are:

Overall Shorted Turns Magnitude

Overall Static Eccentricity Magnitude (rotor bar based)

Overall Dynamic Eccentricity Magnitude (rotor bar based)

Overall Dynamic Eccentricity Magnitude (motor speed sideband based)

Overall Rotor Winding Asymmetry Magnitude (slip-poles sideband based)

Demod slip-poles peak

Demod 1×MS peak

Demod 3×MS peak

Demod 5×MS peak

The first five of these parameters are calculated from the "raw" motor current spectrum, while the last four parameters are calculated from the demodulated motor current spectrum. The magnitudes of each of the nine parameters are normalized by dividing each magnitude by a threshold magnitude that has been determined for each parameter from many fuel pump tests conducted by ORNL. If the normalized result is greater than 1.0, the parameter is identified as "HI". If the normalized result is less than or equal to 1.0, the parameter is identified as "OK". The overall motor condition indicator is the average of all nine normalized results. Since the overall indicator is an average indicator, it is possible that this overall indicator will be "OK" even though one or more individual indicators may be slightly "HI".

The first five of the motor diagnostic parameters were derived from equations that have been reported by Thomson, Rankin, and Dorrell in the following publications herein incorporated by reference:

1. W. T. Thomson, D. Rankin, and D. G. Dorrell, "On-line Current Monitoring to Diagnose Airgap Eccentricity in Large Three-Phase Induction Motors—Industrial Case Histories Verify the Predictions", IEEE Transactions on Energy Conversion, Vol. 14, No. 4, December 1999.

2. William T. Thomson, "On-Line MCSA to Diagnose Shorted Turns in Low Voltage Stator Windings of 3-Phase Induction Motors Prior to Failure"

The equations predict frequency components that are believed to be associated with shorted turns, static eccentricity, dynamic eccentricity, and rotor winding asymmetry. All of these methods depend on knowing the motor speed; hence, the capability to determine motor speed automatically is essential to the invention.

According to Thomson, Rankin, and Dorrell, the following equation can be used to determine several frequency components that are related to shorted turns:

$$f_{st} = f_1\left|\frac{n}{p}(1-s) \pm k\right|$$

where $f_{st}$ represents frequencies that are a function of shorted turns, $f_1$ is the line frequency, n can be 1, 2, 3, etc., k can be 1, 3, 5, etc., p is the number of pole pairs, and s is the motor slip. In this context, motor slip is a dimensionless parameter and is calculated as follows:

$$s = \frac{SYN - MS}{SYN}$$

where SYN is the synchronous speed of the motor in Hz, and MS is the motor speed in Hz.

Motor test results described by Thomson show that components calculated using the conditions k=1, n=3 and k=1, n=5 are particularly sensitive to shorted turns. The FPCM software automatically locates these components in each phase current signal and measures their magnitudes. In all, the magnitudes of twelve components are measured, since there are two possible frequency components for each condition, two conditions, and three motor phases (2×2×3=12). The average of these twelve components is calculated, normalized and displayed as the Overall Shorted Turns Magnitude.

The rotor of an electric motor may exhibit eccentricity in two ways: static and dynamic. Static eccentricity describes a condition when the rotor is displaced from the stator center but is still turning on its own axis. Dynamic eccentricity occurs when the rotor is still turning about the stator center but not on its own center. According to Thomson et al., rotor eccentricity may be caused by many factors, including incorrect bearing positioning during assembly, worn bearings, a bent rotor shaft, and operation at a critical speed creating rotor whirl.

The following two equations provided by Thomson et al. predict the location of static and dynamic eccentricity components based on knowing various motor specifications:

$$F_{se} = f_1\left|R\left(\frac{1-s}{p}\right) \pm n_\omega\right|, \text{ and}$$

$$F_{de} = f_1\left|(R \pm 1)\left(\frac{1-s}{p}\right) \pm n_\omega\right|$$

where $F_{se}$ and $F_{de}$ represent the frequency components associated with static eccentricity and dynamic eccentricity, respectively, $f_1$ is the line frequency, R is the number of rotor bars, s is the slip, p is the number of pole-pairs, and $n_\omega$=1, 3, or 5.

Therefore, these equations predict that six static eccentricity peaks and twelve dynamic eccentricity peaks may be present in the spectrum of each phase signal (T1, T2, and T3). Altogether, eighteen static eccentricity peak magnitudes are measured, averaged, normalized, and displayed as the Overall Static Eccentricity Magnitude (rotor bar based). In a similar manner, all thirty-six dynamic eccentricity peak magnitudes are measured, averaged, normalized, and displayed as the Overall Dynamic Eccentricity Magnitude (rotor bar based).

Thomson et al., also report that dynamic eccentricity induces additional frequency components at the following two frequencies:

$$F_{de}=f_1 \pm f_r$$

where $F_{de}$ represents the two frequencies associated with dynamic eccentricity, $f_1$ is the line frequency and $f_r$ is the motor speed. The magnitudes of these two sideband peaks in all phase signals (T1, T2, and T3) are averaged, normalized, and displayed as the Overall Dynamic Eccentricity Magnitude (motor speed sideband based).

Thomson et al. specify where frequency components will occur due to rotor winding asymmetry and rotor bar degradation:

$$F_{rw}=f_1(1 \pm 2s)$$

where $F_{rw}$ are the two line frequency side-band components resulting from rotor winding asymmetry and rotor bar degradation. The magnitudes of these two sideband peaks in all phase signals are averaged, normalized, and displayed as the Overall Rotor Winding Asymmetry Magnitude (slip-poles sideband based).

Due to the inherent relationships between several key components in the demodulated motor current spectrum and sideband peaks in the "raw" motor current spectrum identified by Thomson et al. as being motor condition related, four peaks from the demodulated motor current spectrum are included in the motor diagnostic parameter group. These peaks are located at the slip-poles frequency and at the first three harmonics of motor speed (1×, 3×, and 5×). As with the other motor diagnostic measurements, these peak magnitudes are measured, normalized and displayed as the Demod slip-poles peak, the Demod 1×MS peak, the Demod 3×MS peak, and the Demod 5×MS peak.

Each motor diagnostic parameter is measured and normalized by dividing its magnitude by a threshold magnitude for that parameter. These threshold magnitudes were defined based on many fuel pump tests carried out by ORNL. They represent the best estimate as to the line between "good" and "bad" condition. Therefore, if a parameter magnitude were greater than the threshold magnitude, it would indicate an abnormal, or "bad" condition. The threshold magnitudes presently being used by the C-141 FPCM software are provided in the table below.

| Motor Diagnostic Parameter | Threshold Magnitude |
|---|---|
| Overall Shorted Turns Magnitude | 5.0 E–4 |
| Overall Static Eccentricity Magnitude (rotor bar based) | 1.0 E–3 |
| Overall Dynamic Eccentricity Magnitude (rotor bar based) | 2.0 E–4 |
| Overall Dynamic Eccentricity Magnitude (motor speed sideband based) | 1.0 E–3 |
| Overall Rotor Winding Asymmetry Magnitude (slip-poles sideband based) | 1.5 E–3 |
| Demod slip-poles peak | 1.5 E–3 |
| Demod 1 × MS peak | 1.0 E–3 |
| Demod 3 × MS peak | 2.0 E–3 |
| Demod 5 × MS peak | 2.0 E–4 |

Note:
The threshold magnitudes may be adjusted in the future as a direct result of continued testing of fuel pumps.

Figure 2:
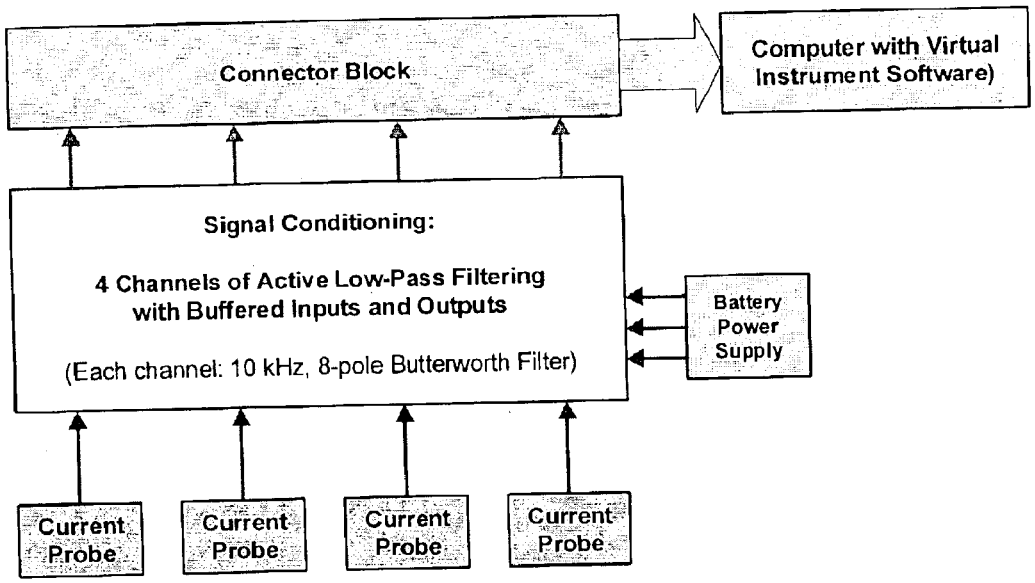
FIG. 2 is a schematic layout for the fuel pump condition monitor system
Figure 18:
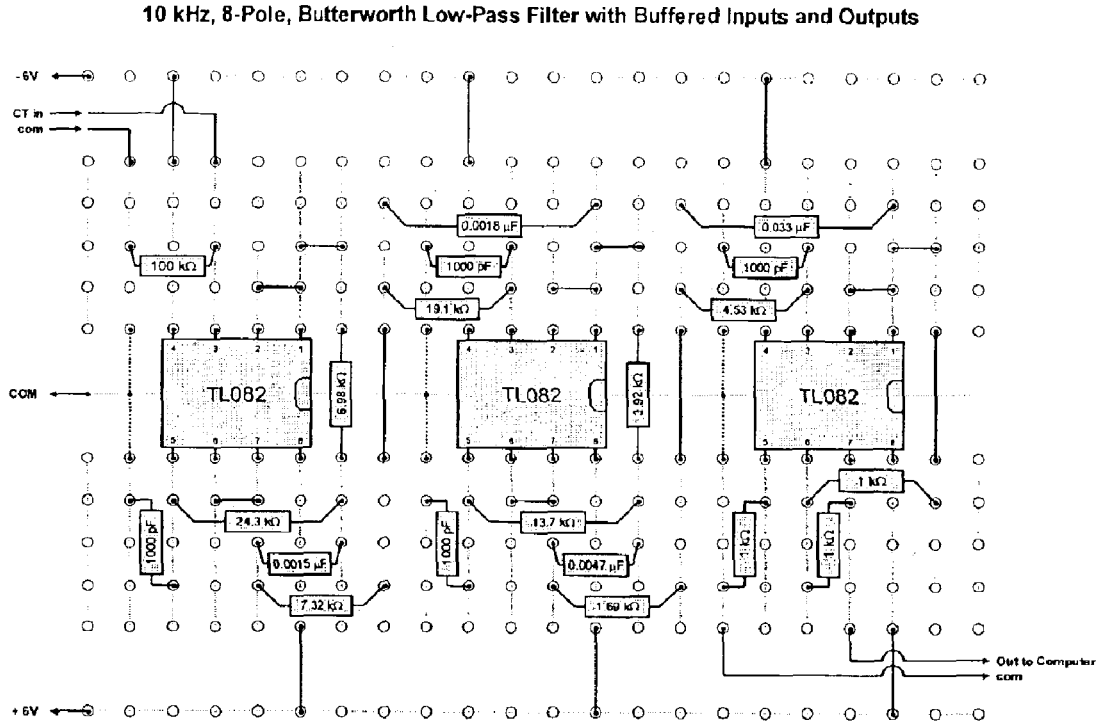
FIG. 18 is a circuit diagram showing the 10 kHz, 8-pole, Butterworth low-pass filter with buffered inputs and outputs.

A simplified layout for the fuel pump condition monitor system is shown in FIG. 2. The signal conditioning circuits were constructed on general-purpose circuit boards that followed the layout shown in FIG. 18. Only one filter circuit is shown. The FPCM system uses four identical circuits for the four independent current channels. The black lines represent conductive paths on top of the circuit board and the gray lines represent conductive paths below the circuit board. Not shown are anti-oscillation capacitors that are connected between both positive (+V) and negative (−V) voltage rails to common (corn).

We claim:

1. A pump diagnostic system comprising:

current sensing probes, exclusive of voltage probes, removably disposed on electrical motor leads of a pump for sensing only current signals on incoming motor power, a signal processor having means for buffering and anti-aliasing said current signals into a pump motor current signal, and a computer having a means for analyzing, displaying, and reporting motor current signatures from said motor current signal to determine pump health using integrated motor and pump diagnostic parameters, and wherein said pump health is determined by normalizing at least nine motor and pump diagnostic parameters using predetermined threshold magnitudes for each parameter to calculate an overall motor condition, wherein, said diagnostic parameters include overall shorted turns magnitude, overall static eccentricity magnitude (rotor bar based), overall dynamic eccentricity magnitude (rotor bar based), overall dynamic eccentricity magnitude (motor speed sideband based), overall rotor winding asymmetry magnitude (slip-poles sideband based), demo slip-poles peak, demo 1×ms peak, demo 3×ms peak, and demo 5×ms peak.

2. The pump diagnostic system of claim 1 wherein said signal processor further comprises at least one active low-pass fixed-cutoff frequency filter.

3. The pump diagnostic system of claim 2 wherein said filter is an 8-stage Butterworth filter.

4. The pump diagnostic system of claim 1 wherein said computer determines the motor speed from said motor current signal.

5. The pump diagnostic system of claim 4 wherein said computer determines the motor line voltage from said motor current signal and said motor speed.

6. The pump diagnostic system of claim 1 wherein said pump is a fuel pump.

7. The pump diagnostic system of claim 1 wherein said current probes are clamp-on type.

8. The pump diagnostic system of claim 1 wherein said incoming motor power is single phase alternating current.

9. The pump diagnostic system of claim 1 wherein said incoming motor power is three phase alternating current.

10. The pump diagnostic system of claim 1 wherein said signal processor and computer are powered by an internal battery supply.

11. The pump diagnostic system of claim 1 wherein said signal processor and computer are powered by an external power supply.

12. The pump diagnostic system of claim 1 wherein said signal processor further comprises at least one active low-pass adjustable-cutoff frequency filter.

13. The pump diagnostic system of claim 1 wherein said computer integrates multiple diagnostic parameters to objectively determine pump system health.

14. The pump diagnostic system of claim 1 wherein said computer determines the change in noise floor from said motor current signal to detect bearing wear in said pump.

15. The pump diagnostic system of claim 1 wherein said computer demodulates the motor current signal.

16. A method of determining pump system health comprising the steps of:

sensing only current signals, exclusive of voltage signals, on incoming motor power leads using current probes, processing said current signals into a pump motor current signal using a signal processor having a means for buffering and anti-aliasing, and determining pump system health from integrated motor and pump diagnostic parameters using a computer having a means for analyzing, displaying, and reporting motor current signatures wherein said pump health is determined by normalizing at least nine motor and pump diagnostic parameters using predetermined threshold magnitudes for each parameter to calculate an overall motor condition, wherein, said diagnostic parameters include overall shorted turns magnitude, overall static eccentricity magnitude (rotor bar based), overall dynamic eccentricity magnitude (rotor bar based), overall dynamic eccentricity magnitude (motor speed sideband based), overall rotor winding asymmetry magnitude (slip-poles sideband based), demo slip-poles peak, demo 1×ms peak, demo 3×ms peak, and demo 5×ms peak.

17. The method of claim 16 wherein said signal processor further comprises at least one active low-pass fixed-cutoff frequency filter.

18. The method of claim 17 wherein said filter is an 8-stage Butterworth filter.

19. The method of claim 16 wherein said computer determines the motor speed from said motor current signal.

20. The method of claim 19 wherein said computer determines the motor line voltage from said motor current signal and said motor speed.

21. The method of claim 16 wherein said pump is a fuel pump.

22. The method of claim 16 wherein said current probes clamp-on type.

23. The method of claim 16 wherein said incoming motor power is single phase alternating current.

24. The method of claim 16 wherein said incoming motor power is three phase alternating current.

25. The method of claim 16 wherein said signal processor and computer are powered by an internal battery supply.

26. The method of claim 16 wherein said signal processor and computer are powered by an external power supply.

27. The method claim 16 wherein said signal processor further comprises at least one active low-pass variable-cutoff frequency filter.

28. The method of claim 16 wherein said computer integrates multiple diagnostic parameters to objectively determine pump system health.

29. The method claim 16 wherein said computer determines the change in noise floor from said motor current signal to detect bearing wear in said pump.

* * * * *